United States Patent [19]

Crawford

[11] 4,397,115

[45] Aug. 9, 1983

[54] OVERHEAD DOOR

[76] Inventor: Jacob H. Crawford, Crawford Airport, Williston, Tenn. 38076

[21] Appl. No.: 299,775

[22] Filed: Sep. 4, 1981

[51] Int. Cl.[3] ..... E06B 7/00

[52] U.S. Cl. ..... 49/70; 49/197; 49/114

[58] Field of Search ..... 49/75, 76, 70, 104, 49/109, 110, 114, 170, 168, 169; 160/189, 201, 188, 193, 213

[56] References Cited

U.S. PATENT DOCUMENTS

| | | | |
|---|---|---|---|
| 1,947,691 | 2/1934 | Baldwin et al. | 160/189 |
| 2,433,583 | 12/1947 | Thurman | 160/189 X |
| 2,689,766 | 9/1954 | Blackman | 49/110 X |
| 2,748,855 | 6/1956 | Siems et al. | 49/168 |
| 3,953,940 | 5/1976 | Zaslow | 49/114 X |

*Primary Examiner*—Kenneth Downey
*Attorney, Agent, or Firm*—Walker & McKenzie

[57] ABSTRACT

An overhead door for use in selectively blocking large openings such as aircraft hangar doors, warehouse doors, etc. The door includes a primary or main door member pivotally mounted to the door opening and one or more secondary door members pivotally mounted within the main door member. A tracking mechanism causes the secondary door members to move to a substantially horizontal opened position when the main door member initially begins movement toward a substantially horizontal opened position and to maintain this horizontal position throughout the opening cycle of main door thus providing minimum wind resistance as the door is opened.

10 Claims, 13 Drawing Figures

OVERHEAD DOOR

BACKGROUND OF THE INVENTION

1. Field of the Invention: The present invention relates, in general, to overhead doors primarily but not limited to use in large installations such as aircraft hangars, warehouses, and the like.

2. Description of the Prior Art: Heretofore, various overhead doors have been developed. Baldwin, U.S. Pat. No. 1,947,691; Premo, U.S. Pat. No. 1,994,785; Mosher, U.S. Pat. No. 2,936,830; Houk, U.S. Pat. No. 3,224,494; Doering, U.S. Pat. No. 4,120,341; DeVore, U.S. Pat. No. 4,177,854; DeVore, U.S. Pat. No. 4,243,091; and Aspenson, U.S. Pat. No. 4,124,055 all disclose overhead doors comprised, in general, of a lower section and an upper section pivotally attached to one another whereby the door can be folded in halves when opened. None of the above patents disclose or suggest the present invention.

A problem prevalent with overhead doors used for large installations such as aircraft hangars, warehouses, and the like is that much power is required to operate door either manually or otherwise. A counter-balanced door eliminates this problem but creates another; i.e., overcoming wind resistance. This invention solves this problem by a unique design that provides very minimum wind resistance in a fully integrated counter-balanced door.

SUMMARY OF THE INVENTION

The present invention is directed toward improving upon prior overhead doors. The concept of the present invention is to construct an overhead door in such a manner that one or more portions of the door can be moved fully from a vertical, closed position to a horizontal, opened position as soon as the remainder of the door begins initial movement from a vertical, closed position to a horizontal, opened position whereby the door is subjected to minimum wind resistance as it is being opened.

The overhead door of the present invention comprises, in general, a first door means having an opening therein; a first pivot means for pivotally mounting on the horizontal center line of its exposed area the first door means to the edges of an opening in a wall; a second (or multiple) door means; a second (or multiple) pivot means for pivotally mounting the second (or multiple) door means on the horizontal center line of its exposed area to the edges of the opening in the first door means and for allowing the second (or multiple) door means to move between a substantially vertical closed position to a horizontal opened position soon after first door is started to open and tracking means for causing the second door(s) to maintain a horizontal position throughout the opening cycle of the combined two or more doors.

DESCRIPTION OF THE PREFERRED EMBODIMENT

Figure 1:
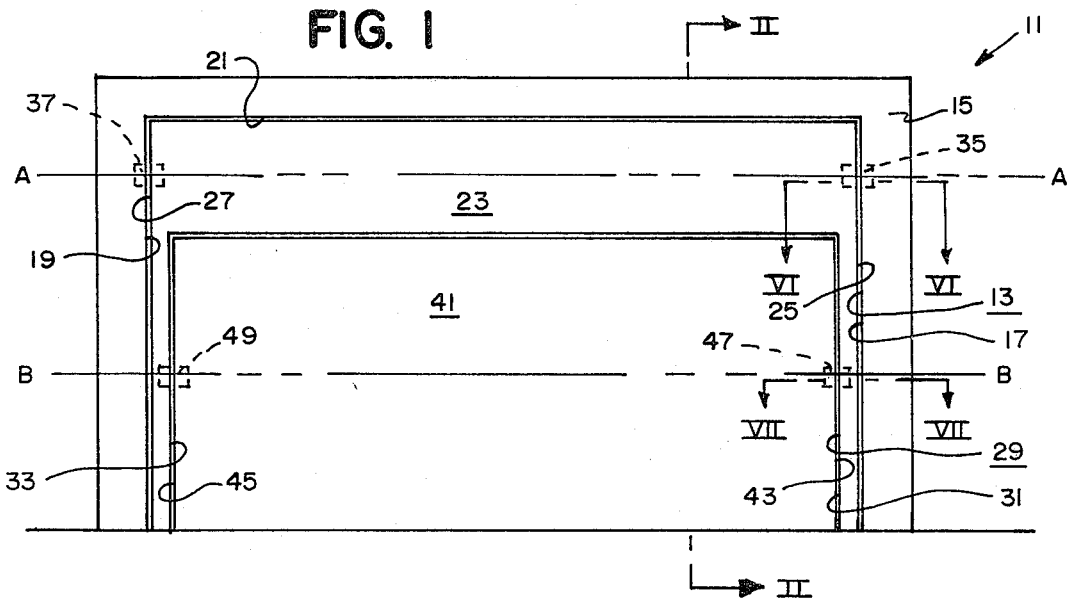
FIG. 1 is a front elevational view of a wall of a building with the overhead door of the present invention mounted therein.

A first embodiment of the overhead door of the present invention is shown in FIGS. 1–12 and referred to by the numeral 11. The overhead door 11 is for use to selectively block a substantially large opening 13 in a wall 15 of a building such as an aircraft hangar, warehouse, or the like. The opening 13 is defined, in part, by a first side edge 17, a second side edge 19, and a top edge 21 (see, in general, FIG. 1).

The overhead door 11 includes a first door means 23 having a first side 25 and a second side 27 and having an opening 29 therein. The opening 29 in the first door means 23 is defined in part by a first side edge 31 and a second side edge 33. The overhead door includes a second door means 41 for selectively blocking the opening 29 in the first door means 23. The second door means 41 has a first side 43 and a second side 45 (see FIG. 1).

Figure 2:
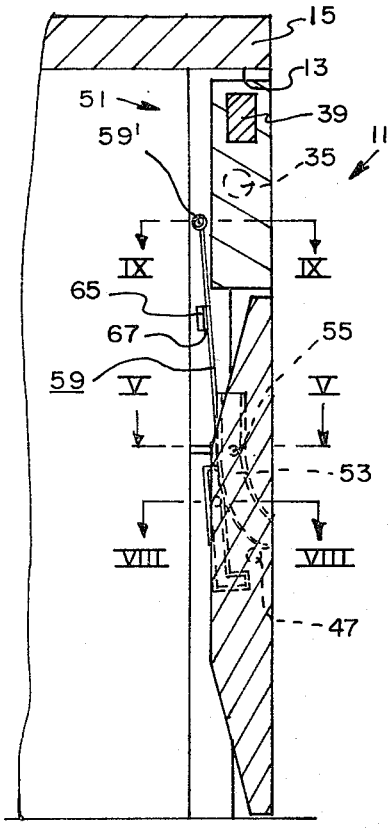
FIG. 2 is an enlarged, somewhat diagrammatic sectional view as taken on line II—II of FIG. 1 with the overhead door of the present invention in a fully closed position.
Figure 4:
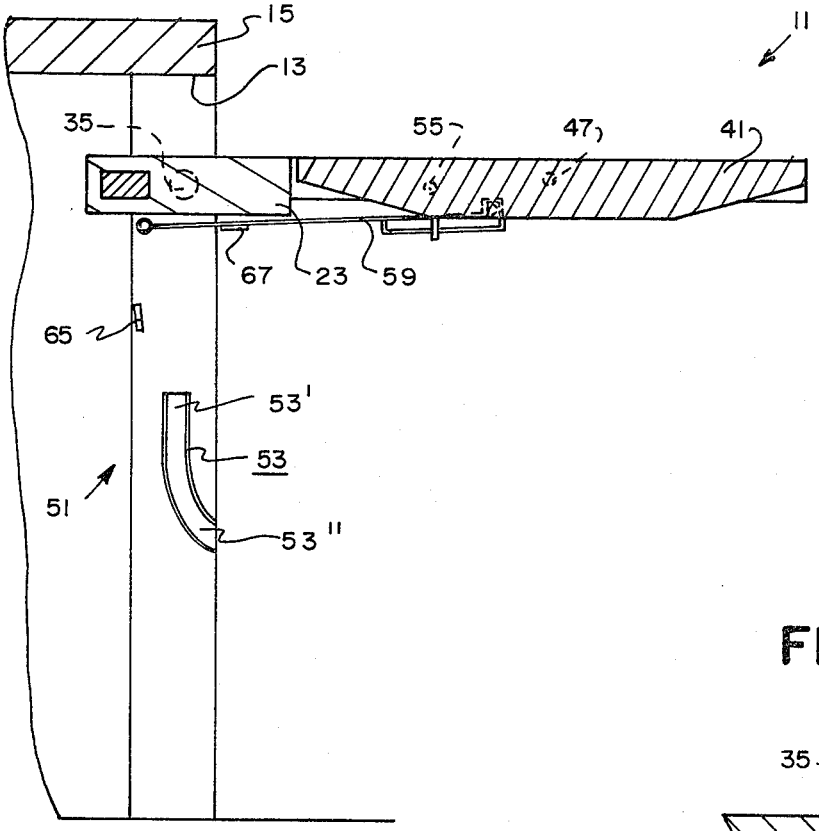
FIG. 4 is a sectional view similar to FIG. 2 but with the overhead door of the present invention in a fully opened position.
Figure 6:
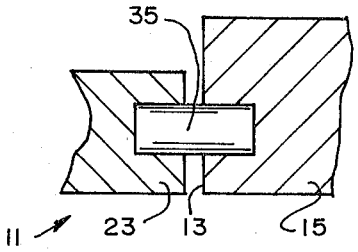
FIG. 6 is an enlarged sectional view as taken on line VI—VI of FIG. 1 with some portions omitted for clarity.
Figure 5:
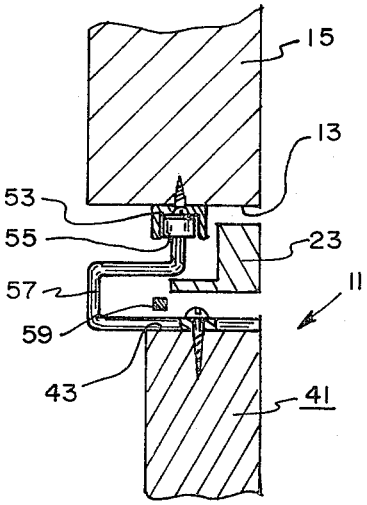
FIG. 5 is an enlarged sectional view as taken on line V—V of FIG. 2 with some portions omitted for clarity.
Figure 7:
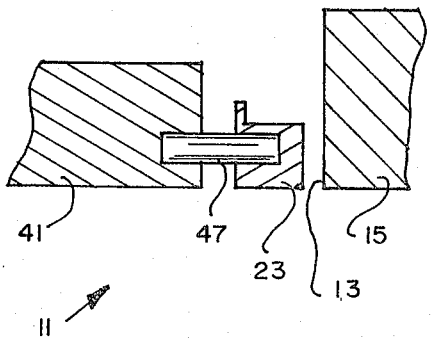
FIG. 7 is an enlarged sectional view as taken on line VII—VII of FIG. 1 with some portions omitted for clarity.
Figure 8:
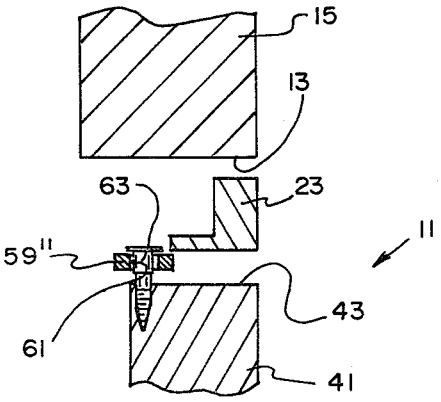
FIG. 8 is an enlarged sectional view as taken on line VIII—VIII of FIG. 2 with some portions omitted for clarity.
Figure 9:
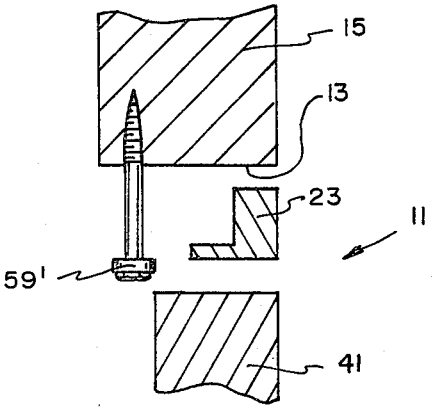
FIG. 9 is an enlarged sectional view as taken on line IX—IX of FIG. 2 with some portions omitted for clarity.
Figure 11:
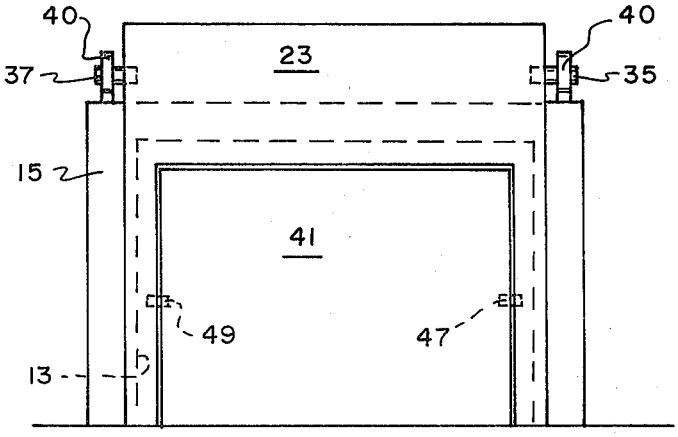
FIG. 11 is a front elevational view of an alternate method of mounting the overhead door of the present invention to a wall.

The overhead door 11 includes a first pivot means for pivotally mounting the first door means 23 to the first and second side edges 17, 19 of the opening 13 in the wall 15 and for allowing the first door means 23 to move between a substantially vertical closed position as shown in FIG. 2 and a substantially horizontal opened position as shown in FIG. 4. The first pivot means preferably includes a first pivot member 35 for pivotally attaching the first side 25 of the first door means 23 to the first side edge 17 of the opening 13 in the wall 15 and preferably includes a second pivot member 37 for pivotally attaching the second side 27 of the first door means 23 to the second side edge 19 of the opening 13 in the wall 15 (see FIG. 1). The first and second pivot members 35, 37 of the first pivot means are preferably located substantially at the center of gravity of the combined first and second door 23, 41 as indicated by the broken line A—A in FIG. 1. Such a location allows the combined first and second door means 23, 41 to easily pivot between the opened and closed positions. It should be noted that in order to position the first and second pivot members 35, 37 at a height which allows substantially all of the opening 13 in the wall 15 to be utilized when the first door means 23 is in the opened position, the first door means 23 may be provided with a ballast 39 such as sand at a location above the first and second pivot members 35, 37 to thereby raise the center of gravity A—A thereof as will now be apparent to those skilled in the art. (In the event that the entire height of the opening 13 is needed, the first door means 23 can be mounted to the exterior of the wall 15 above the opening 13 by way of brackets 40 as clearly shown in FIGS. 11 and 12 whereby the first door means 23 will completely clear the opening 13 when pivoted to the open position as shown in broken lines in FIG. 12). The first and second pivot members 35, 37 may be of any specific construction and operation known to those skilled in the art. For example, the first and second pivot members 35, 37 may be well-known ball bearing type pivot members to allow ease in moving the first door means 33 between the opened and closed positions.

Figure 3:
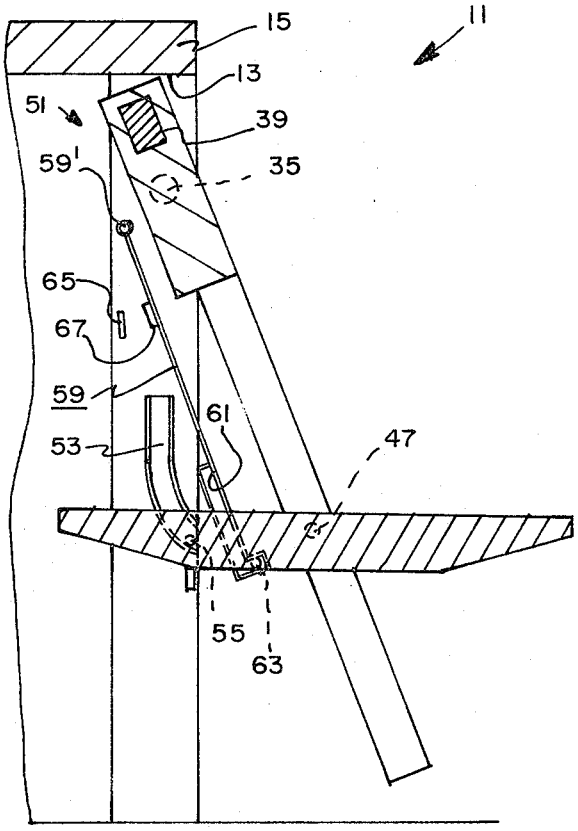
FIG. 3 is a sectional view similar to FIG. 2 but with the overhead door of the present invention in a partially opened position.

The overhead door 11 includes a second pivot means for pivotally mounting the second door means 41 to the first and second side edges 31, 33 of the opening 29 in the first door means 23 and for allowing the second door means 41 to move between a substantially vertical closed position as shown in FIG. 2 and a substantially horizontal opened position as shown in FIGS. 3 and 4. The second pivot means preferably includes a first pivot member 47 for pivotally attaching the first side 43 of the second door means 41 to the first side edge 31 of the opening 29 in the first door means 23 and preferably includes a second pivot member 49 for pivotally attaching the second side 45 of the second door means 41 to the second side edge 33 of the opening 29 in the first door means 23. The first and second pivot members 47, 49 of the second pivot means are preferably located substantially at the center of gravity of the second door means 41 as indicated by the broken line B—B in FIG. 1 to allow the second door means 41 to easily pivot between the opened and closed position. The first and second pivot member 47, 49 may be of any construction and operation known to those skilled in the art. For example, the first and second pivot members 47, 49 may consist of typical ball bearing type pivot members for allowing ease of movement of the second door means 41 between the opened and closed positions.

The overhead door 11 includes tracking means 51, (see, in general, FIGS. 2, 3 and 4) for causing the second door means 41 to move from the closed position as shown in FIG. 2 substantially completely to the horizontal open position and to maintain this position throughout opening cycle as shown in FIGS. 3 and 4 when the first door means 23 initially begins movement from the closed position as shown in FIG. 2 toward the opened position as shown in FIG. 4. The tracking means 51 preferably includes a track means 53 for being attached to the first side edge 17 of the opening 13 in the wall 15 (see, in general, FIGS. 4 and 5), and preferably includes a track follower member 55 for being attached to the first side 25 of the first door means 23 (see, in general, FIG. 5) and for engaging the track means 53 when the second door means 41 is in the closed position. The track means 53 may consist simply of an outwardly directed U-shaped channel member fixedly attached to the first side edge 17 of the opening 13 in the wall 15 by way of screws or the like (see FIG. 5) having an upper end 53' and a lower end 53'' (see FIG. 4). The lower end 53'' of the track means 53 is curved outward as clearly shown in FIG. 4 for reasons which will hereinafter become apparent. The track follower member 55 may consist of a roller for being guided by the sides of the track means 53 as the first and second door means 23, 41 move between the opened and closed positions in a manner which will hereinafter become apparent. The track follower member 55 may be attached to the first side 43 of the first door means 41 by way of a bracket member 57 (see, in general, FIG. 5) which is bent in such a manner so as not to interfere with other portions of the overhead door 11 and which is fixedly attached to the first side 43 of the first door means 41 by way of screws or the like. The coaction between the track means 53 and track follower member 55 will cause the second door means 41 to pivot from the closed position to the opened (horizontal) position when the first door means 23 initially begins movement from the closed position toward the open position, and will cause the second door means 41 to pivot from the opened position to the closed position when the first door means 23 substantially finishes movement from the open position toward the closed position.

Figure 10:
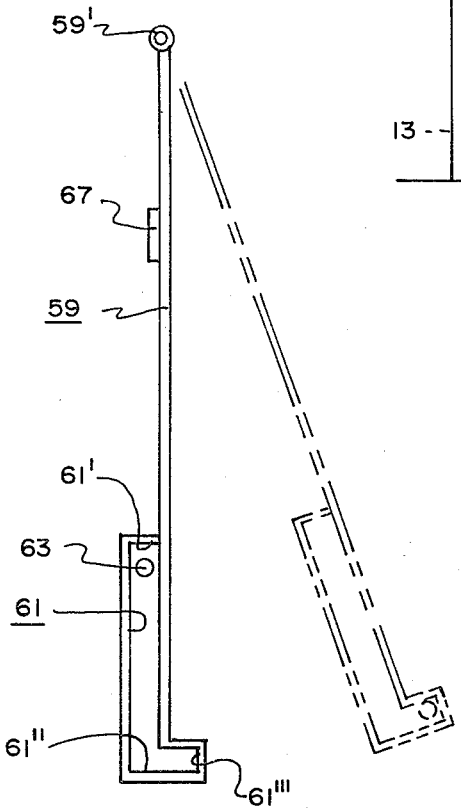
FIG. 10 is a diagrammatic view of a portion of the tracking means of the overhead door of the present invention.
Figure 12:
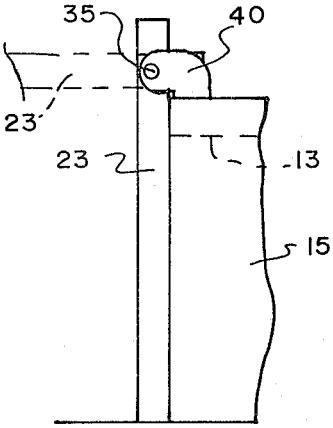
FIG. 12 is a side elevational view of FIG. 11.

The tracking means 51 preferably includes a link member 59 having a first end 59' for being pivotally attached to the first side edge 17 of the opening 13 in the wall 15 and having a second end 59'' (see, in general, FIG. 10). The second end 59'' of the link member 59 has an elongated slot 61 therein. The tracking means 51 also preferably includes a link follower member 63 attached to the first side 43 of the second door means 41 for engaging the slot 51 in the second end 59'' of the link member 59. The slot 51 in the second end 59'' of the link member 59 has an upper end 61' and a lower end 61''. The lower end 61'' of the elongated slot 61 has an offset portion 61''' (see, in general, FIG. 10). The link follower member 63 may consist of a roller attached to the first side 43 of the second door means 41 by way of a screw or the like (see FIG. 8). Gravity forces the link follower member 63 into the offset portion 61''' of the elongated slot 61 in the link member 59 when the first door means 23 moves toward the opened position. The tracking means 51 is preferably provided with bumper means for causing the link follower member 63 to move from the offset portion 61''' of the slot 61 in the link member 59 when the first door means 23 moves toward the closed position. The bumper means may include a first bumper member 65 fixedly mounted to the first side edge 17 of the opening 13 in the wall 15 and a second bumper member 67 fixedly mounted on the link member 59 in a position for contacting the first bumper member 65 when the first door means 23 is moved toward the closed position to thereby cause the link member 59 to be forced upwardly relative to the link follower member 63 thereby causing the link follower member 63 to move from the offset portion 61''' of the slot 61 in the link member 59.

The operation of the overhead door 11 is quite simple. To move the overhead door 11 from the closed position shown in FIG. 2 to the opened position shown in FIG. 4, the first door means 23 is pivoted about the first and second pivot members 35, 37 toward the partially opened position shown in FIG. 3. The manner of applying power to pivot the first door means 23 about the first and second pivot members 35, 37 may vary. For example, an electric motor (not shown) may be coupled to the first door means 23 in a manner apparent to those skilled in the art for causing the first door means 23 to pivot about the first and second pivot members 35, 37 when the electric motor is activated in a certain direction. On the other hand, the first door means 23 may be merely manually pivotally, with minimum effort, about the first and second pivot members 35, 37. As the first door means 23 starts to pivot about the first and second pivot members 35, 37, the track means 53 and track follower member 55 will coact to almost immediately cause the second door means 41 to pivot from the closed position shown in FIG. 1 to the opened position shown in FIGS. 3 and 4. Continued pivoting movement of the first door means 23 toward the fully opened position shown in FIG. 4 will allow gravity to cause the link member 59 to move so as to trap the link follower member 63 in the offset portion 61''' of the elongated slot 61 thereof to hold or lock and maintain the second door means 41 in the substantially horizontal position throughout the opening cycle shown in FIGS. 3 and 4. To move the overhead door 11 from the opened position shown in FIG. 4 to the closed position shown in FIG. 3, it is merely necessary to pivot the first door means 23 about the first and second pivot member 35, 37 in the opposite directions. As the first door means approaches the substantially closed (or partially opened) position in FIG. 3, the first and second bumper members 65, 67 will coact to cause the link member 59 to move so as to free the link follower member 63 from the offset portion 61''' of the elongated slots 61 thereof thereby allowing the second door means 41 to pivot from the substantially horizontal opened position shown in FIG. 3 to the substantially vertical closed position shown in FIG. 2. The second door means 41 is caused to pivot from the opened position to the closed position by the coaction of the track means 53 and track follower member 55 as the first door means 23 makes its final movements toward the substantially vertical closed position shown in FIG. 2.

The specific construction of the overhead door 11 may vary. For example, the first and second door means 23, 41 may be of a light-weight, open framework construction with a sheet metal skin as will be apparent to those skilled in the art. The door means 23, 41 are preferably constructed in a substantially weather proof manner (not shown) in any way now apparent to those skilled in the art.

Figure 13:
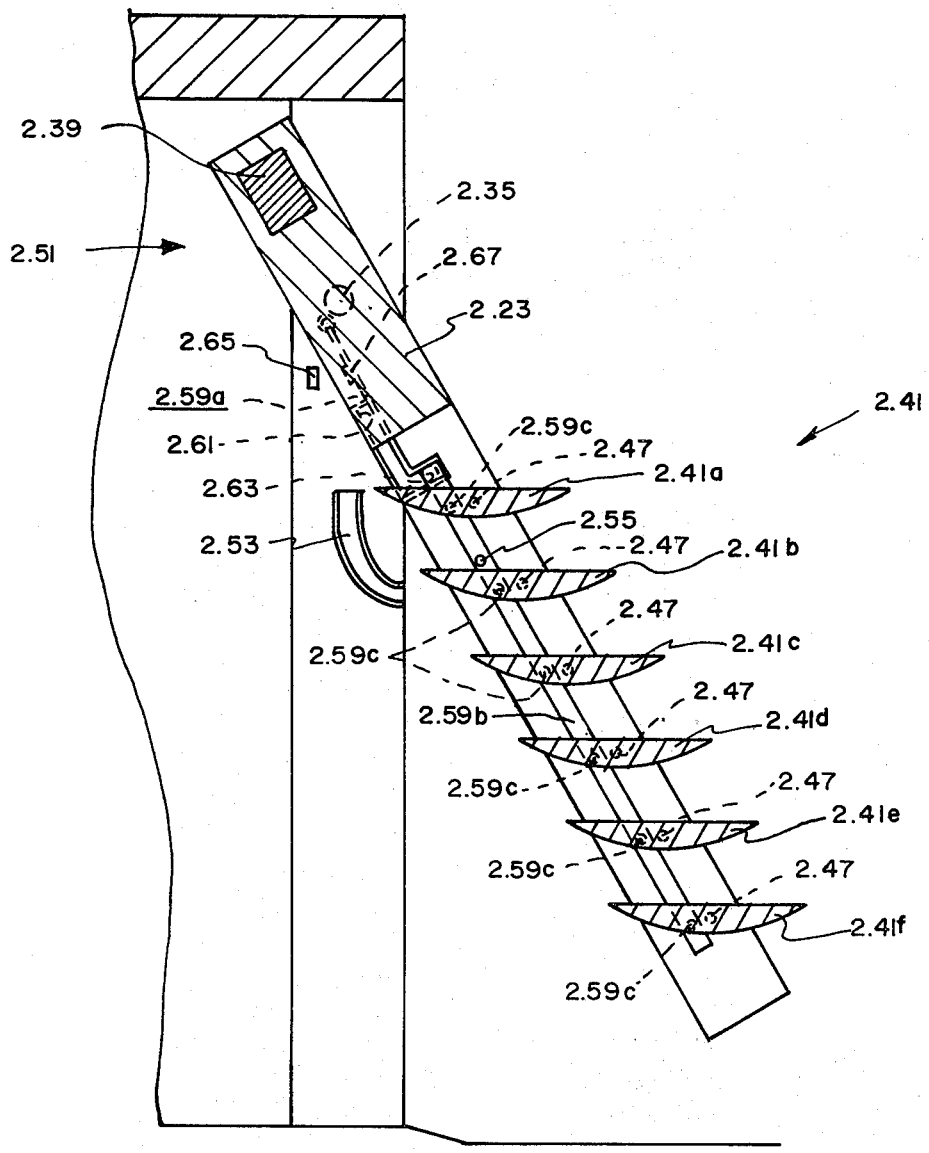
FIG. 13 is a sectional view similar to FIG. 3 but of an alternate embodiment of the overhead door of the present invention.

A second embodiment of the overhead door of the present invention is shown in FIG. 13 and referred to by the numeral 2.11. The overhead door 2.11 is substantially similar to the overhead door 11 and includes, in general, a first door means 2.23, pivot means such as pivot member 2.35 for mounting the first door means 2.23 to a wall, ballast 2.39, second door means 2.41, tracking means 2.51, bumper means such as the bumper members 2.65, 2.67, etc. However, the second door means 2.41 of the second embodiment includes a plurality of louver-type door members **2.41*a*, 2.41*b*, 2.41*c*, 2.41*d*, 2.41*e*, 2.41*f* pivotally attached to the side edge of the opening in the first door means 2.23 by pivot means such as the pivot members 2.47. Each door member 2.41*a*–2.41*f* is pivotally attached to the first door means 2.23 substantially at its own center of gravity. The tracking means 2.51 of the second embodiment operates in substantially the same manner as the as the tracking means 51. However, the tracking means 2.51 has a first, or upper link member 2.59*a* that is pivotally attached at its upper end to one side edge of the opening in the wall and that has an elongated slot 2.61 in its lower end. The tracking means 2.51 has a second or lower link member 2.59*b* that is pivotally attached to each of the door members 2.41*a*–2.41*f* by way of pivot members 2.59*c* or the like. The link follower member 2.63 is attached to the lower link member 2.59*b* for coacting with the slot 2.61 in the same manner as heretofore described relative to the slot 61 and link follower member 63 of the tracking means 51. The track follower member 2.55 is also attached to the lower link member 2.59*b* for coacting with the track means 2.53 in the same manner as heretofore described relative to the track means 53 and track follower member 55 of the tracking means 51**. The construction and operation of the second embodiment should now be apparent to those skilled in the art.

Although the invention has been described and illustrated with respect to the preferred embodiment thereof and a preferred use therefore, it is not to be so limited since changes and modifications can be made therein which are within the full intended scope of the invention.

I claim:

1. An overhead door for selectively blocking an opening in a wall, the opening being defined in part by a first side edge and a second side edge, said door comprising:

(a) first door means having a first side and a second side and having an opening therein, said opening in said first door means being defined by a first side edge and a second side edge;

(b) first pivot means for pivotally mounting said first door means to the first and second side edge of the opening in the wall and for allowing said first door means to move between a substantially vertical closed position and a substantially horizontal opened position;

(c) second door means having a first side and a second side;

(d) second pivot means for pivotally mounting said second door means to said first and second side edges of said opening in said first door means and for allowing said second door means to move between a substantially vertical closed position and a substantially horizontal opened position; and (e) tracking means for causing said second door means to move from said closed position substantially completely to said horizontal position when said first door means initially begins movement from said closed position toward said opened position and to maintain said horizontal position until said first door means has reached said opened position.

2. The overhead door of claim 1 in which said tracking means includes track means for being attached to the first side edge of the opening in the wall, and includes a track follower member for being attached to said first side of said second door means and for engaging said track means when said second door means is in said closed position.

3. The overhead door of claim 2 in which said track means has an upper end and a lower end, said lower end of said track means being curved for coacting with said track follower member to cause said second door means to pivot about said second pivot means between said closed and opened positions.

4. The overhead door of claim 3 in which said tracking means includes a link member having a first end for being pivotally attached to the first side edge of the opening in the wall and having a second end, said second end of said link member having an elongated slot therein; and in which said tracking means includes a link follower member attached to said first side of said second door means for engaging said slot in said second end of said link member.

5. The overhead door of claim 4 in which said slot in said second end of said link member has an upper end and a lower end, said lower end of said slot having an offset portion.

6. The overhead door of claim 5 in which gravity forces said link follower member into said offset portion of said slot in said link member when said first door means moves toward said opened position, and in which said tracking means includes bumper means for causing said link follower member to move from said offset portion of said slot in said link member when said first door means moves toward said closed position.

7. The overhead door of claim 6 in which said first pivot means is located substantially at the combined center of gravity of said first and second door means and in which said second pivot means is located substantially at the center of gravity of said second door means.

8. The overhead door of claim 1 in which said second door means includes a plurality of louver-type door members.

9. The overhead door of claim 8 in which said tracking means includes a first link member pivotally attached to the first side edge of the opening in the wall at its upper end and having an elongated slot in its lower end; in which said tracking means includes a second link member pivotally attached to each of said plurality of louver-type door members of said second door means; and in which said tracking means includes a link follower member attached to said second link member for engaging said slot in said first link member.

10. The overhead door of claim 9 in which said tracking means includes track means for being attached to the first side edge of the opening in the wall, and includes a track follower member for being attached to said second link member and for engaging said track means when said second door means is in said closed position.

* * * * *